US010016110B2

(12) United States Patent
Makarov

(10) Patent No.: US 10,016,110 B2
(45) Date of Patent: Jul. 10, 2018

(54) CYCLONIC VACUUM CLEANER AND DIRT SEPARATOR

(71) Applicant: TECHTRONIC FLOOR CARE TECHNOLOGY LIMITED, Tortola (VG)

(72) Inventor: Sergey V. Makarov, Solon, OH (US)

(73) Assignee: Techtronic Floor Care Technology Limited, Tortola (VG)

( * ) Notice: Subject to any disclaimer, the term of this patent is extended or adjusted under 35 U.S.C. 154(b) by 636 days.

(21) Appl. No.: 14/640,676

(22) Filed: Mar. 6, 2015

(65) Prior Publication Data

US 2015/0173576 A1 Jun. 25, 2015

Related U.S. Application Data

(63) Continuation of application No. 13/552,409, filed on Jul. 18, 2012, now Pat. No. 8,973,215.

(51) Int. Cl.
*A47L 9/16* (2006.01)
*A47L 5/28* (2006.01)

(52) U.S. Cl.
CPC ..... *A47L 9/165* (2013.01); *A47L 5/28* (2013.01); *A47L 9/1633* (2013.01)

(58) Field of Classification Search
CPC ..... A47L 9/165; A47L 9/1633
See application file for complete search history.

(56) References Cited

U.S. PATENT DOCUMENTS 3,710,554 A 1/1973 Brookman
5,224,976 A 7/1993 Oranje
6,141,826 A 11/2000 Conrad et al.
6,334,234 B1 1/2002 Conrad et al.
6,344,064 B1 2/2002 Conrad
6,375,720 B2 4/2002 Embree et al.
6,376,732 B1 4/2002 Ngan et al.
6,391,095 B1 5/2002 Conrad et al.
6,398,973 B1 6/2002 Saunders et al.
(Continued)

FOREIGN PATENT DOCUMENTS

EP 1772091 4/2007
FR 1152393 A * 2/1958 ..... A47L 5/18
(Continued)

OTHER PUBLICATIONS

FR1152393A (machine translation), 1958.*
European Extended Search Report for Application No. 13193052 dated Feb. 2, 2014 (6 pages).

*Primary Examiner* — Andrew A Horton
(74) *Attorney, Agent, or Firm* — Michael Best & Friedrich LLP

(57) ABSTRACT

A vacuum cleaner operable to separate debris from an air stream. The vacuum cleaner includes a first cyclonic separator and a second cyclonic separator having an inlet configured to receive the air stream from the first cyclonic separator. The inlet of the second cyclonic separator directs the air steam in an inlet flow direction from an upper end of the first housing toward a lower end of the first housing and along a longitudinal axis into the second cyclonic separator. The inlet of the second cyclonic separator has an inlet cross-sectional area for flow of the air stream measured normal to the longitudinal axis that decreases in the inlet flow direction.

14 Claims, 6 Drawing Sheets

(56) References Cited

U.S. PATENT DOCUMENTS

| | | | |
|---|---|---|---|
| 6,428,589 | B1 | 8/2002 | Bair et al. |
| 6,485,536 | B1 | 11/2002 | Masters |
| 6,540,917 | B1 | 4/2003 | Rachels et al. |
| 6,582,489 | B2 | 6/2003 | Conrad |
| 6,818,033 | B2 | 11/2004 | North |
| 6,837,912 | B1 | 1/2005 | Heumann |
| 6,936,095 | B2 | 8/2005 | North |
| 6,989,039 | B2 | 1/2006 | Vuijk |
| 7,065,826 | B1 | 6/2006 | Arnold |
| 7,258,713 | B2 | 8/2007 | Eubank et al. |
| 7,279,020 | B2 | 10/2007 | Christiansen et al. |
| 7,288,129 | B2 | 10/2007 | Oh et al. |
| 7,311,744 | B2 | 12/2007 | Elliott |
| 7,335,241 | B2 | 2/2008 | Oh et al. |
| 7,419,522 | B2 | 9/2008 | Arnold |
| 7,445,651 | B2 | 11/2008 | Lane et al. |
| 7,455,708 | B2 | 11/2008 | Conrad et al. |
| 7,544,224 | B2 | 6/2009 | Tanner et al. |
| 7,604,675 | B2 | 10/2009 | Makarov et al. |
| 7,632,324 | B2 | 12/2009 | Makarov et al. |
| 7,637,991 | B2 | 12/2009 | Eddington et al. |
| 7,662,201 | B2 | 2/2010 | Lee |
| 7,722,693 | B2 | 5/2010 | Yoo et al. |
| 2004/0112018 | A1 | 6/2004 | Vuijk |
| 2005/0155177 | A1 | 7/2005 | Baer et al. |
| 2007/0011998 | A1 | 1/2007 | Yoo et al. |
| 2007/0144116 | A1 | 6/2007 | Hong et al. |
| 2007/0234687 | A1 | 10/2007 | Ni |
| 2008/0047091 | A1 | 2/2008 | Nguyen |
| 2008/0115469 | A1 | 5/2008 | Lane et al. |
| 2008/0196197 | A1 | 8/2008 | Conrad et al. |
| 2008/0289139 | A1 | 11/2008 | Makarov et al. |
| 2009/0133370 | A1 | 5/2009 | Yoo et al. |
| 2009/0217635 | A1 | 9/2009 | Bertram et al. |
| 2009/0241491 | A1 | 10/2009 | Han et al. |
| 2009/0265883 | A1 | 10/2009 | Reed, Jr. et al. |
| 2009/0282791 | A1 | 11/2009 | Lang |
| 2009/0300872 | A1 | 12/2009 | Griffith et al. |
| 2009/0300874 | A1 | 12/2009 | Tran et al. |

FOREIGN PATENT DOCUMENTS

| | | |
|---|---|---|
| GB | 2287667 | 9/1995 |
| WO | 2012146616 | 11/2012 |

* cited by examiner

CYCLONIC VACUUM CLEANER AND DIRT SEPARATOR

CROSS-REFERENCE TO RELATED APPLICATIONS

This application is a continuation of U.S. patent application Ser. No. 13/552,409, filed Jul. 18, 2012, the entire contents of which are hereby incorporated by reference herein.

BACKGROUND

The present invention relates to cyclonic vacuum cleaners.

Cyclonic vacuum cleaners often include a base or foot and an upright handle pivotally attached to the base. A dirt separator can be removably attached to the upright handle, and the dirt separator can include a first cyclonic stage, a second cyclonic stage downstream from the first cyclonic stage, and a dirt cup to collect dirt separated from the first and the second cyclonic stages. Dirt and air is often drawn through an inlet aperture in the base and transported to the dirt separator. The dirt and air enter the first cyclonic stage of the separator where cyclonic action separates dirt, which falls into the dirt cup, and the relatively clean air travels to the second cyclonic stage. In the second cyclonic stage, cyclonic action separates relatively fine dirt that still remains in the air. The relatively fine dirt falls into the dirt cup and the relatively clean air is discharged to the atmosphere.

SUMMARY

In one embodiment, the invention provides a vacuum cleaner operable to separate debris from an air stream. The vacuum cleaner includes a first housing having an upper end, a lower end, a first longitudinal axis, and an inner wall that surrounds the first longitudinal axis, and the inner wall at least partially defines a first cyclonic separator having an inlet configured to receive the air stream. A second housing is located at least partially within the first housing, and the second housing includes a second longitudinal axis and an inner wall that surrounds the second longitudinal axis, and the inner wall of the second housing at least partially defines a second cyclonic separator having an inlet configured to receive the air stream from the first cyclonic separator. The vacuum cleaner further includes a dirt cup in fluid communication with the first and second cyclonic separators, and the dirt cup is configured to receive the debris separated from the air stream by the first and second cyclonic separators. The inlet of the second cyclonic separator directs the air steam in an inlet flow direction from the upper end of the first housing toward the lower end of the first housing and along the second longitudinal axis into the second cyclonic separator. The inlet of the second cyclonic separator has an inlet cross-sectional area for flow of the air stream measured normal to the second longitudinal axis that decreases in the inlet flow direction.

In another embodiment the invention provides a vacuum cleaner operable to separate debris from an air stream. The vacuum cleaner includes a first housing having an upper end, a lower end, a first longitudinal axis and an inner wall that surrounds the first longitudinal axis, and the inner wall at least partially defines a first cyclonic separator having an inlet configured to receive the air stream. A second housing is located at least partially within the first housing, and the second housing includes a second longitudinal axis and an inner wall that surrounds the second longitudinal axis, and the inner wall of the second housing at least partially defines a second cyclonic separator having an inlet configured to receive the air stream from the first cyclonic separator. The vacuum cleaner further includes a dirt cup in fluid communication with the first and second cyclonic separators, and the dirt cup is configured to receive the debris separated from the air stream by the first and second cyclonic separators, and a vane extends at least partially around and along the second longitudinal axis and is located at least partially within the inlet of the second cyclonic separator. The vane is configured to rotate the air stream about the second longitudinal axis. An air outlet duct is in fluid communication with the second cyclonic separator to transport the air stream from the first cyclonic separator. The inlet of the second cyclonic separator directs the air steam in an inlet flow direction from the upper end of the first housing toward the lower end of the first housing along the second longitudinal axis and into the second cyclonic separator, an the air outlet duct transports the air stream from the first cyclonic separator in an outlet flow direction from the lower end of the first housing toward the upper end of the first housing along the second longitudinal axis.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
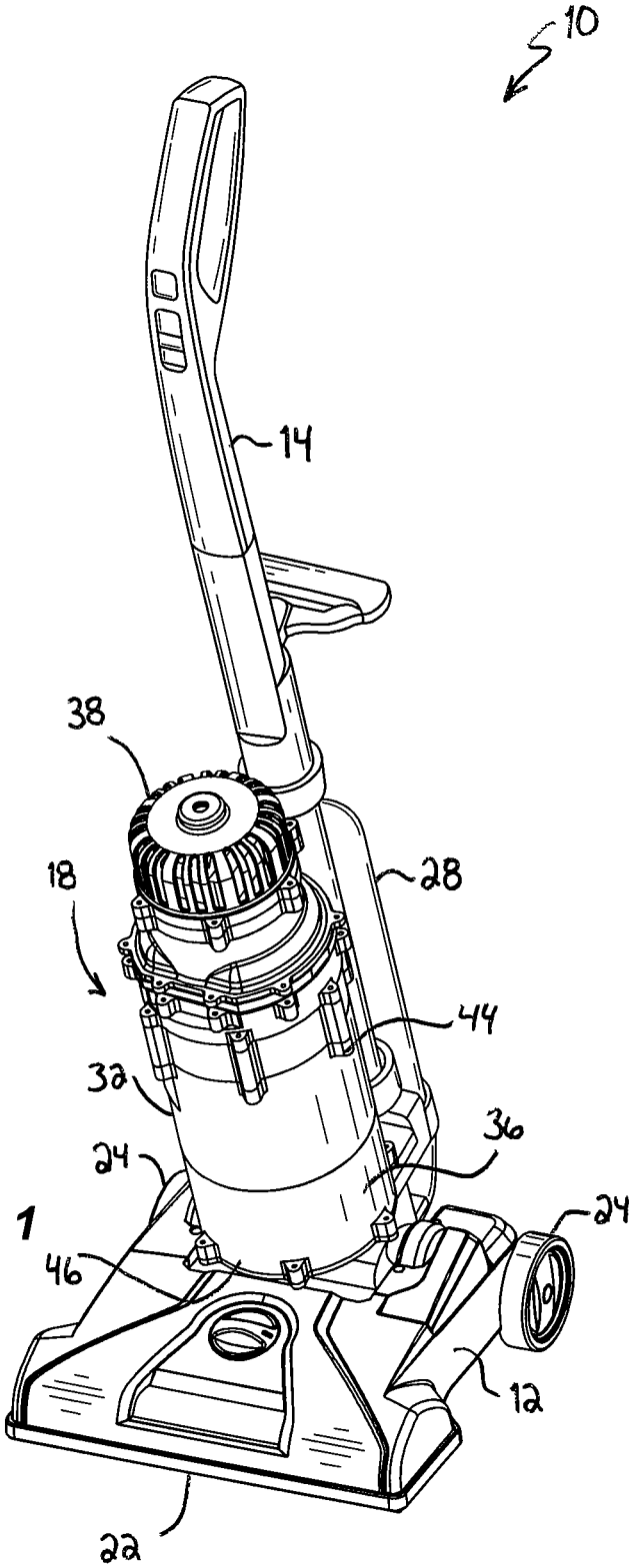
FIG. 1 is a perspective view of a vacuum cleaner according to one embodiment of the invention.

FIG. 1 illustrates a vacuum cleaner 10 that includes a base 12, a handle 14, and a dirt separator assembly 18. The base 12 includes a suction inlet 22 and wheels 24 to facilitate movement of the base 12 along a surface to be cleaned. In the illustrated embodiment, the handle 14 is pivotally coupled to the base 12 such that the handle 14 pivots relative to the base 12 between an upright storage position, which is illustrated in FIG. 1, and an inclined operating position. In the illustrated embodiment, a conduit 28 extends along the handle 14 and provides fluid communication between the suction inlet 22 and the dirt separator assembly 18.

Figure 2:
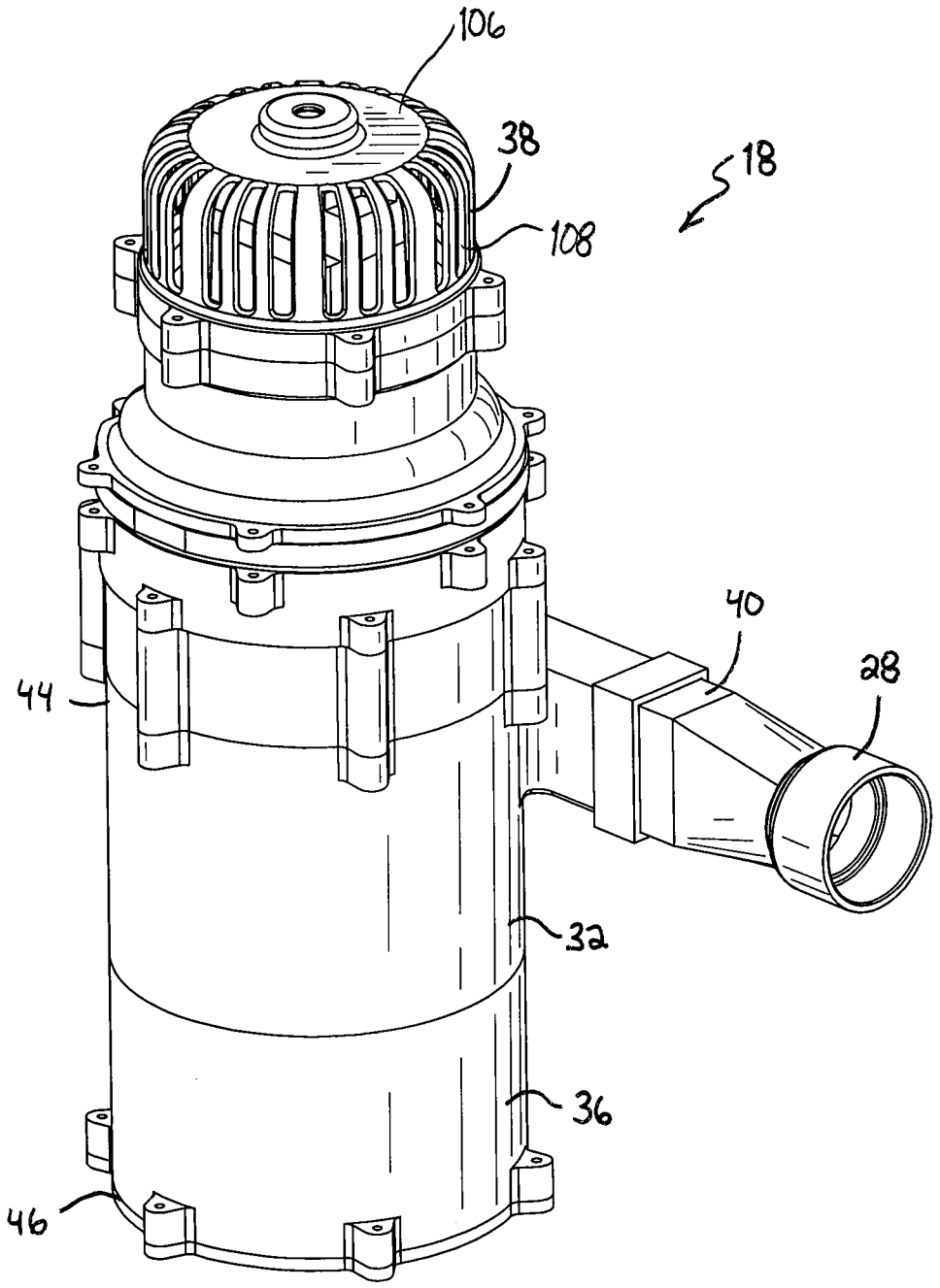
FIG. 2 is a perspective view of a dirt separator assembly of the vacuum cleaner of FIG. 1.
Figure 4:
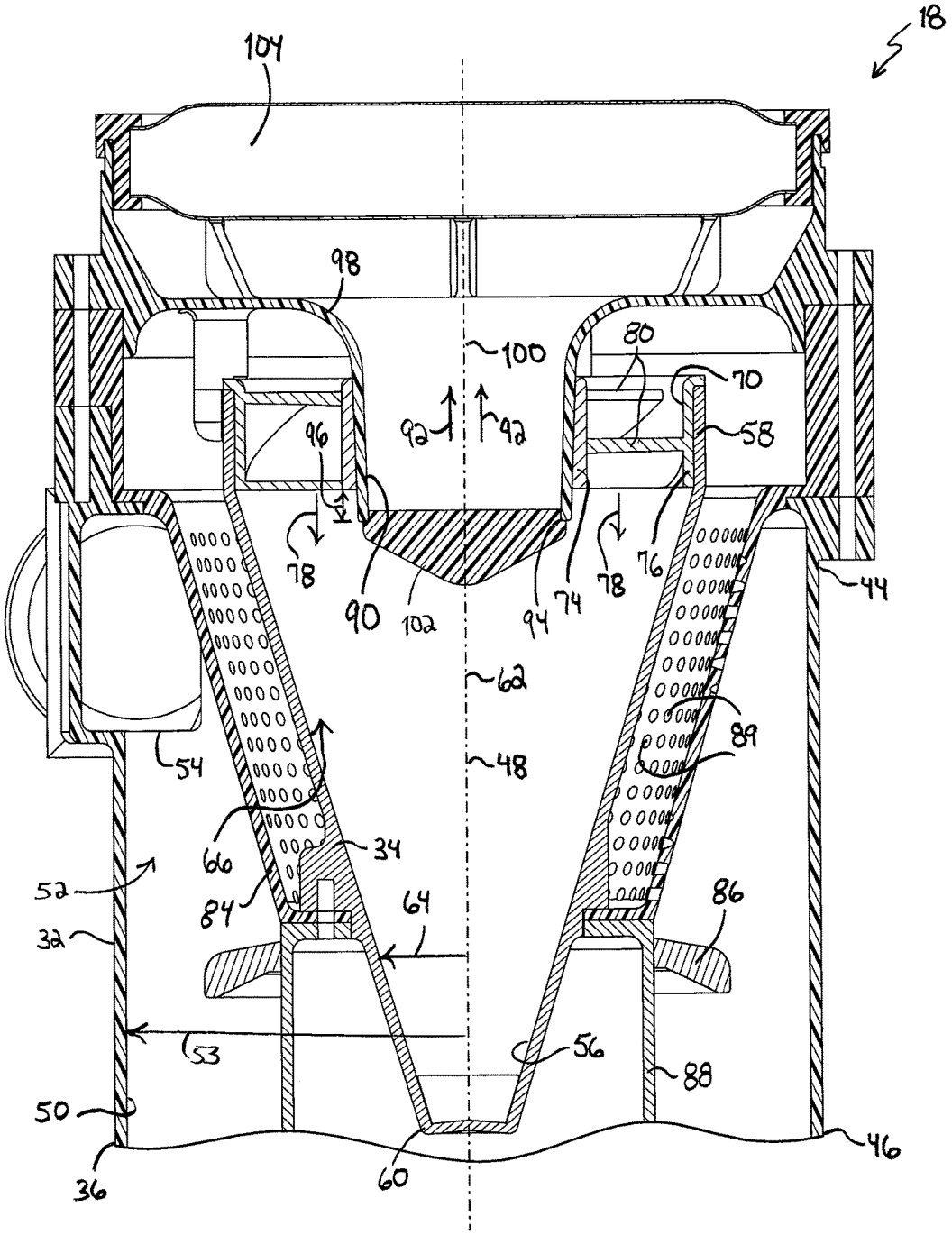
FIG. 4 is a cross-sectional view of a portion of the dirt separator assembly of FIG. 3 taken along line 4-4 of FIG. 3.

Referring to FIGS. 2 and 4, the dirt separator assembly 18 includes a first housing 32, a second housing 34, a dirt cup 36, a motor and fan assembly 38, and an inlet conduit 40. The illustrated first housing 32 forms an outer housing of the dirt separator assembly 18 and the outer housing 32 includes an upper end 44 and a lower end 46. The dirt cup 36 is coupled to the lower end 46 of the outer housing 32 and the inlet conduit 40 extends from the housing 32 adjacent the upper end 44 of the housing 32. The outer housing 32 further includes a longitudinal axis 48 that extends centrally through the upper end 44 and the lower end 46 of the housing 32. An inner wall 50 of the housing 32 surrounds the longitudinal axis 48 and defines a first cyclonic separator 52, which is a first stage separator in the illustrated embodiment. In the illustrated embodiment, the inner wall 50 is cylindrically shaped such that the inner wall 50 defines a radius 53 about the longitudinal axis 48 that is generally constant along the length of the inner wall 50 from the upper end 44 to the lower end 46. The first cyclonic separator 52 includes an inlet 54 adjacent the upper end 44 of the housing 32 and the inlet 54 is in fluid communication with the inlet conduit 40.

The second housing 34 forms an inner housing of the dirt separator assembly 18 in the illustrated embodiment, and the inner housing 34 is partially located within the outer housing 32. The housing 34 includes an inner wall 56 that is generally frusto-conically shaped in the illustrated embodiment. The housing 34 further includes an upper end 58 and a lower end 60 and the frusto-conical inner wall 56 is located between the ends 58 and 60. A longitudinal axis 62 of the housing 34 extends centrally through the ends 58 and 60 of the housing 34 and the inner wall 56 surrounds the axis 62 such that a radius 64 measured from the axis 62 to the inner wall 56 varies constantly along the axis 62 and is constant about the axis 62 at points along the axis 62. The inner wall 56 defines a second cyclonic separator 66, which is a second stage cyclonic separator in the illustrated embodiment. Although the illustrated embodiment includes only a single second stage cyclonic separator, in other embodiments, the dirt separator assembly 18 may include multiple second stage cyclonic separators. Also, the separator 66 is the final cyclonic stage of the separator 18 in the illustrated embodiment, but in other embodiments, the separator may include additional stages (e.g., a tertiary stage).

The second cyclonic separator 66 includes an inlet 70 that receives air from the first cyclonic separator 52. The illustrated inlet 70 is adjacent the upper end 44 of the outer housing 32 and the upper end 58 of the second housing 34. The inlet 70 includes an inner wall 74 and an outer wall 76. The inner wall 74 is generally cylindrical and surrounds the longitudinal axis 62 of the second cyclonic separator 66, and in the illustrated embodiment, the longitudinal axis 62 is concentric with the inner wall 74. The outer wall 76 surrounds the inner wall 74 and is also generally cylindrical and the outer wall 76 is concentric with the inner wall 74. The walls 74 and 76 guide an air stream in an inlet flow direction, generally represented by arrows 78 in FIG. 4, from the upper end 44 of the first housing 32 toward the lower end 46 of the first housing 32 along the longitudinal axis 62 of the second cyclonic separator 66. An inlet cross-sectional area for flow of the air stream is measured normal to the axis 62 between the walls 74 and 76, and in the illustrated embodiment, the inlet cross-sectional area for flow is an annular area.

Figure 3:
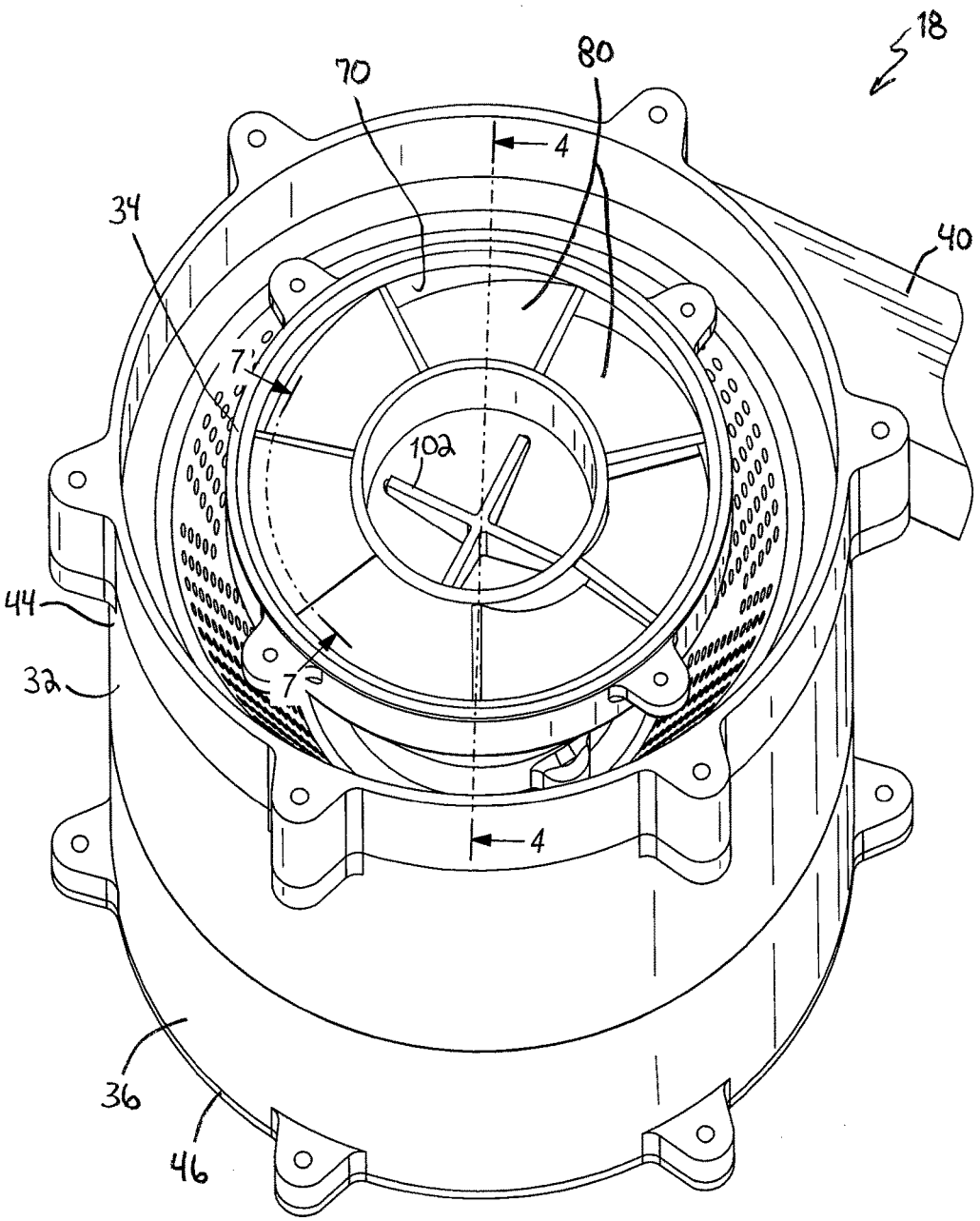
FIG. 3 is a perspective view of a portion of the dirt separator assembly of FIG. 2.

Referring to FIGS. 3 and 4, the inlet 70 further includes helical vanes 80 that extend through the inlet cross-sectional area and the vanes 80 are helical such that the vanes 80 extend around the longitudinal axis 62 and along the longitudinal axis 62 in the inlet flow direction 78. The vanes 80 extend from the inner wall 74 to the outer wall 76. The inlet 70 of the second cyclonic separator 66 directs the air stream in the inlet flow direction 78 from the upper end 44 of the first housing 32 toward the lower end 46 of the first housing 32 along the longitudinal axis 62 of the second cyclonic separator 66 and into the second cyclonic separator 66. Meanwhile, the vanes 80 rotate the air stream about the axis 62.

Referring to FIG. 4, the illustrated dirt separator assembly 18 includes a shroud 84, a skirt 86, and a support 88. The shroud 84 includes apertures 89 and the shroud 84 is located between the first cyclonic separator 52 and the second cyclonic separator 66 to filter any remaining relatively large debris in the air stream between the first and second separator 52 and 66. The skirt 86 is attached to the support 88 and the skirt 86 minimizes the amount of debris in the dirt cup 36 that becomes re-entrained in the air stream by minimizing the airflow past the skirt 86 between the dirt cup 36 and the first cyclonic separator 52. The support 88 extends from a lower wall of the dirt cup 36 to support the shroud 84, the skirt 86 and the inner housing 34 within the outer housing 32.

The dirt cup 36 is located below the first and second cyclonic separators 52 and 66 to receive and collect dirt and debris separated from the air stream by the separators 52 and 66. The dirt cup 36 is located adjacent the lower end 46 of the outer housing 32.

Referring to FIG. 4, the dirt separator assembly 18 further includes an air outlet duct 90. The air outlet duct 90 is in fluid communication with the second cyclonic separator 66 to transport the air stream from the second cyclonic separator 66 in an outlet flow direction, generally represented by arrow 92 in FIG. 4, in a direction from the lower end 46 of the outer housing 32 toward the upper end 44 of the outer housing 32 along the longitudinal axis 62 of the second cyclonic separator 66. The outlet duct 90 includes an inlet 94 that is located within the second cyclonic separator 66 in the illustrated embodiment. Therefore, the inlet 94 is spaced a distance 96 measured parallel to the longitudinal axis 62 in the inlet flow direction from the air inlet 70 of the second cyclonic separator 66 to define a gap between the inlet 94 of the air outlet duct 90 and the inlet 70 of the second cyclonic separator 66. The gap, represented by the distance 96, minimizes the amount of air from the air stream that by-passes the second cyclonic separator 66 and travels from the inlet 70 directly into the outlet duct 90 without traveling through the separator 66 to remove debris from the air stream.

The air outlet duct 90 further includes an outlet 98, and in the illustrated embodiment, the outlet 98 is formed as a divergent nozzle. A longitudinal axis 100 extends centrally through the inlet 94 and the outlet 98, and in the illustrated embodiment, the longitudinal axis 100 is co-axial with the longitudinal axis 62 of the second cyclonic separator 66. And, in the illustrated embodiment, the outlet duct 90 extends through the inlet 70 such that the inner wall 74 of the inlet 70 surrounds the outlet duct 90. The air outlet duct 90 further includes a flow straightening member 102 that straightens the air stream (i.e., reduces swirling) as it travels through the duct 90.

With continued reference to FIG. 4, the dirt separator assembly 18 further includes a filter 104. The illustrated filter 104 is a pre-motor filter (i.e., positioned upstream of the motor and fan assembly 38). The filter 104 can include a pleated filter, foam filter, and the like. Furthermore, although only one filter 104 is illustrated in FIG. 4, the assembly 18 can include more the one filter (i.e., multiple stage filters). The divergent nozzle 98 of the outlet duct 90 expands the air stream in a direction generally normal to the axis 100 before the air stream travels through the filter 104 to maximize the surface area of the filter 104 that is utilized to filter the air stream.

Referring to FIGS. 1 and 2, the motor and fan assembly 38 is coupled to the outer housing 32 adjacent the upper end 44 of the housing 32 and the assembly 38 includes a motor housing 106 having exhaust vents 108. The motor and fan assembly 38 operates as a suction source to generate the air stream. In the illustrated embodiment, the motor and fan assembly 38 is coupled to the housing 32 such that the motor and fan assembly 38 is removable from the handle 14 and the base 12 with the dirt separator assembly 18 as a single component. Also, in the illustrated embodiment, the motor and fan assembly includes a direct current (DC) motor powered by a rechargeable battery (e.g., lithium-ion rechargeable battery). In other embodiments, the motor and fan assembly can be powered by 120 volt alternating current.

In operation, the user provides power to the motor and fan assembly 38, such as by operating a switch, which generates the air stream. The air stream draws dirt and debris along with the air stream through the suction inlet 22. The air stream, entrained with dirt and debris, travels up the conduit 28. Referring to FIG. 4, the air stream then enters the first cyclonic separator 52 through the inlet 54. Cyclonic action causes relatively heavy dirt and debris to be separated from the air stream and fall into the dirt cup 36 (FIG. 2). The air stream the travels through the apertures 89 of the shroud 84 and into the inlet 70. The inlet 70 guides the air stream in the inlet flow direction 78 and the helical vanes 80 rotate the air stream about the axis 62. The air stream enters the second cyclonic separator 66 where cyclonic action separates relatively fine dust and debris from the air stream. The separated dust and debris falls via gravity into the dirt cup 36 and the relatively clean air stream travels in the outlet flow direction 92 into the outlet duct 90. The air stream is further cleaned by the filter 104 before being exhausted to the atmosphere through the exhaust vents 108 in the motor housing 106.

Figure 5A:
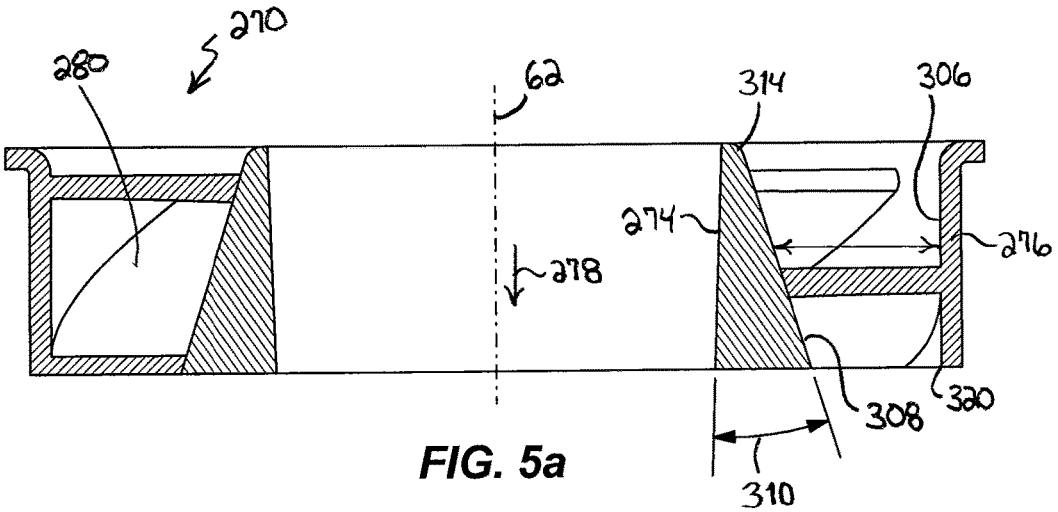
FIG. 5*a* is a cross-sectional view of an inlet for a second cyclonic separator for a dirt separator according to another embodiment.
Figure 5B:
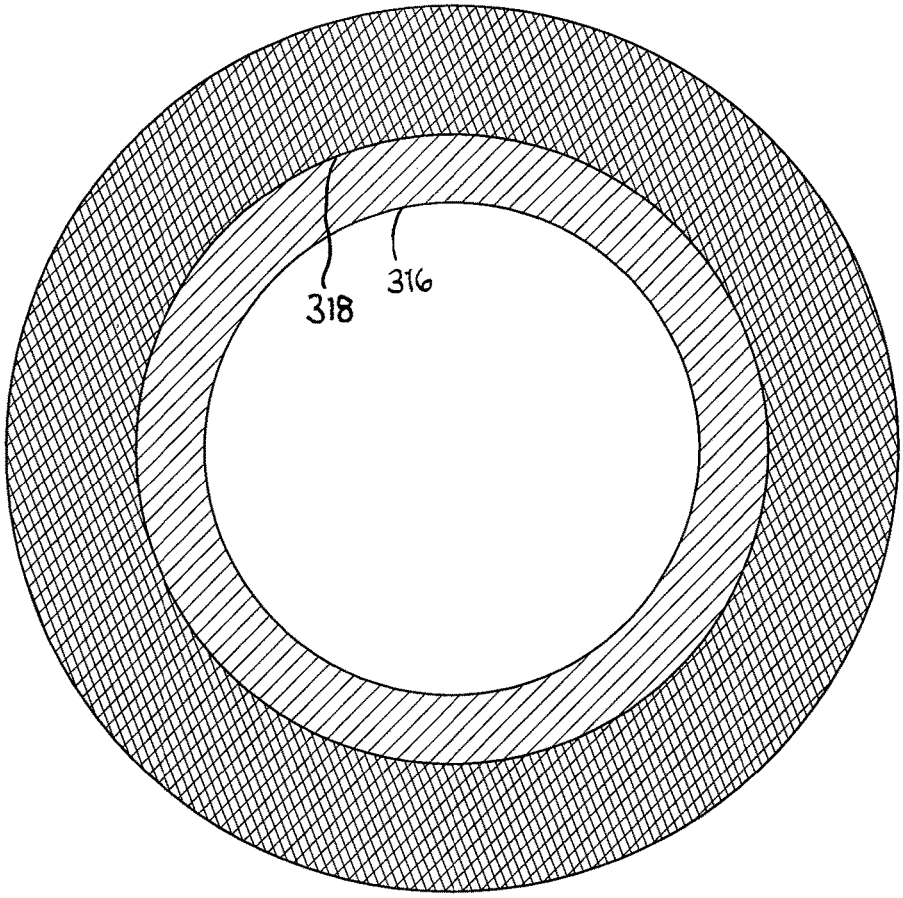
FIG. 5*b* schematically illustrates an inlet cross-sectional area for the inlet of FIG. 5*a*

FIG. 5*a* illustrates an inlet 270 according to another embodiment for use with the dirt separator assembly 18. The inlet 270 of FIG. 5*a* is similar to the inlet 70 of FIGS. 1-4. Accordingly, only differences between the inlets 70 and 270 will be discussed in detail below and like components having been given like reference numbers plus 200. The axial inlet 270 includes an outer wall 276 having an inner surface 306 along which the air stream travels, and the inner surface 306 faces an inner surface 308 of the inner wall 274 along which the air stream travels. The inner surface 306 of the outer wall 276 is generally parallel to the axis 62 when the inlet 270 is used with the dirt separator assembly 18 described above, and the inner surface 308 of the inner wall 274 is at an acute angle 310 with respect to the axis 62 as illustrated in FIG. 5. In the illustrated in embodiment, the angle 310 is about 20 degrees. In other embodiments, the angle 310 can range from about 10 degrees to about 30 degrees. The inner wall 274 tapers in the inlet flow direction 278 such that a distance 312 between the walls 274 and 276 measured normal to the axis 62 decreases in the inlet flow direction 278 to decrease the inlet cross-sectional area for the flow of the air stream. Alternatively stated, referring to FIGS. 5*a* and 5*b*, an upstream end 314 of the inlet 270 has an upstream cross-sectional area 316 for flow of the air stream greater than a downstream cross-sectional area 318 for flow at a downstream end 320. A flow area ratio is defined as the area 316 divided by the area 318, and in the illustrated embodiment, the flow area ratio is about 1.4, and in other embodiments the flow area ratio is in the range from 1.2 to 1.6, and in yet other embodiments, the flow area ratio is greater than 1. Thus, the axial inlet 270 of FIG. 5*a* converges from the upstream end 314 to the downstream end 320 to increase the velocity of the air stream as it travels through the inlet 270.

Figure 6:
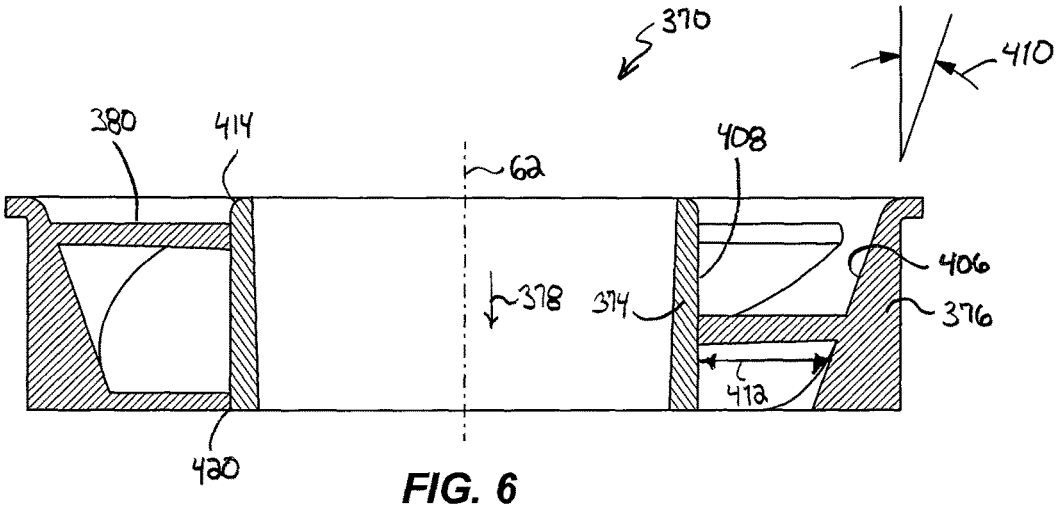
FIG. 6 is a cross-sectional view of an inlet for a second cyclonic separator for a dirt separator according to yet another embodiment.

FIG. 6 illustrates an inlet 370 according to another embodiment for use with the dirt separator assembly 18. The inlet 370 of FIG. 6 is similar to the axial inlet 270 of FIGS. 5*a* and 5*b*. Accordingly, only differences between the inlets 270 and 370 will be discussed in detail below and like components having been given like reference numbers plus 100. The axial inlet 370 includes an outer wall 376 having an inner surface 406 along which the air stream travels, and the inner surface 406 faces an inner surface 408 of an inner wall 374 along which the air stream travels. The inner surface 408 of the inner wall 374 is generally parallel to the axis 62 when the inlet 370 is used with the dirt separator assembly 18 described above, and the inner surface 406 of the outer wall 376 is at an acute angle 410 with respect to the axis 62 as illustrated in FIG. 6. In the illustrated in embodiment, the angle 410 is about 20 degrees. In other embodiments, the angle 410 can range from about 10 degrees to about 30 degrees. The outer wall 376 tapers in the inlet flow direction 378 such that a distance 412 between the walls 374 and 376 measured normal to the axis 62 decreases in the inlet flow direction 378 to decrease the inlet cross-sectional area for the flow of the air stream. Alternatively stated, an upstream end 414 of the inlet 370 has an upstream cross-sectional area for flow of the air stream greater than a downstream cross-sectional area for flow at a downstream end 420. A flow area ratio is defined as the upstream cross-sectional area divided by the downstream cross-sectional area, and in the illustrated embodiment the flow area ratio is about 1.4, and in other embodiments the flow area ratio is in the range from 1.2 to 1.6, and in yet other embodiments, the flow area ratio is greater than 1. Thus, the axial inlet 370 of FIG. 6 converges from the upstream end 414 to the downstream end 420 to increase the velocity of the air stream as it travels through the inlet 370.

Figure 7:
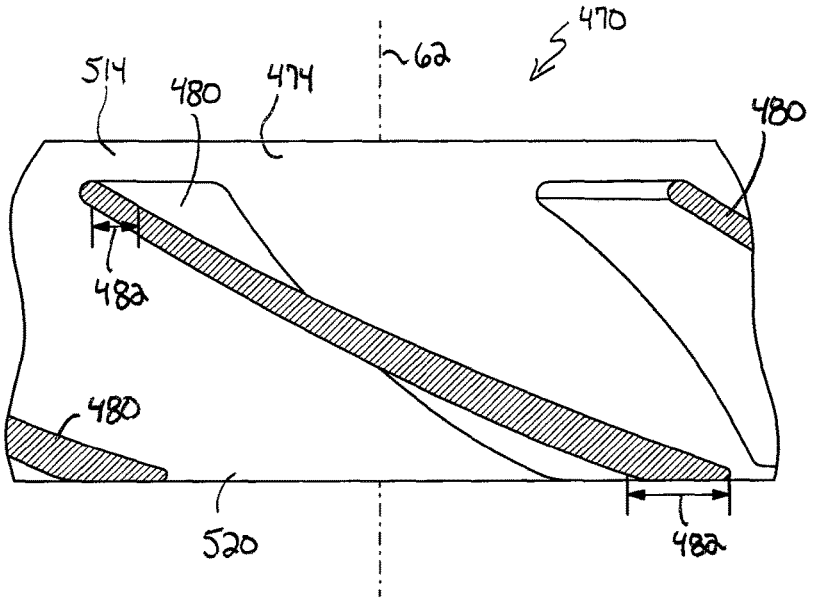
FIG. 7 is a cross-sectional view taken along lines 7-7 of FIG. 3 but illustrating an inlet for a second cyclonic separator for a dirt separator according to yet another embodiment.

FIG. 7 illustrates an inlet 470 according to another embodiment for use with the dirt separator assembly 18. The axial inlet 470 of FIG. 7 is similar to the axial inlet 70 of FIGS. 1-4. Accordingly, only differences between the inlets 70 and 470 will be discussed in detail below and like components having been given like reference numbers plus 400. The inlet 470 includes helical vanes 480 having a vane thickness 482, measured around the longitudinal axis 62 and normal to the axis 62 as illustrated in FIG. 7. The vane thickness 482 increases from an upstream end 514 of the inlet 470 to a downstream end 520 of the inlet 470. Because the vanes 480 are thinner at the upstream end 514 and thicker at the downstream end 520, an upstream cross-sectional flow area defined between adjacent vanes 480 is greater than a downstream end cross-sectional flow area. Thus, the flow area at the upstream end 514 converges toward the downstream end 520 to increase the velocity of the air stream as it travels through the inlet 470. The helical vanes 470 of FIG. 7 with variable vane thickness 482 may be used with any of the inlets 70, 270, and 370 described herein.

Various features and advantages of the invention are set forth in the following claims.

What is claimed is:

1. A vacuum cleaner comprising:

a dirt separator assembly operable to separate debris from an air stream, the dirt separator assembly including, a first housing forming a first cyclonic separator having a cyclone inlet configured to receive the air stream, a second housing forming a second cyclonic separator having an upper end and a lower end, the second housing at least partially within the first housing and the second housing having a longitudinal axis that extends along the length of the second housing, a second housing inlet to receive the air stream from the first cyclonic separator adjacent the upper end of the second housing and to direct the air stream in an inlet flow direction toward the lower end of the second housing and along the longitudinal axis of the second housing, the second housing inlet including, an inner wall and an outer wall forming an annular inlet cross-sectional area between the inner and outer walls, a plurality of helical vanes extending between the inner wall and the outer wall, the plurality of helical vanes directing the air stream around the longitudinal axis of the second housing and along the longitudinal axis in the inlet flow direction, wherein the inlet cross-sectional area for flow of the air stream measured normal to the longitudinal axis decreases in the inlet flow direction, wherein the inner wall tapers along the inlet flow direction decreasing the second housing inlet cross sectional area in the inlet flow direction, and a dirt cup in fluid communication with the first and second cyclonic separators configured to receive the debris separated from the air stream by the first and second cyclonic separators.

2. The vacuum cleaner according to claim 1, wherein the upper end of the second housing is positioned above the first cyclonic separator.

3. The vacuum cleaner according to claim 1, wherein the plurality of helical vanes extend radially from the inner wall to the outer wall.

4. The vacuum cleaner according to claim 1, wherein the plurality of helical vanes extend between the inner wall and the outer wall approximately normal to the longitudinal axis.

5. The vacuum cleaner according to claim 1, wherein the second housing inlet is positioned in the upper end of the second housing.

6. The vacuum cleaner according to claim 5, wherein the second housing inlet is removably coupled to the second cyclonic separator.

7. The vacuum cleaner according to claim 1, wherein the first housing extends along the longitudinal axis.

8. The vacuum cleaner according to claim 1, wherein the thickness of at least one of the plurality of vanes increases in the inlet flow direction.

9. The vacuum cleaner according to claim 1, further comprising a shroud including a plurality of apertures, the shroud surrounding the second housing within the first housing.

10. The vacuum cleaner of claim 1, further comprising a generally cylindrical support for the second housing, the generally cylindrical support located within the first housing.

11. The vacuum cleaner of claim 1, wherein the upper end of the second housing is generally cylindrical and wherein the outer wall of the second housing inlet is generally cylindrical, and wherein the outer wall of the second housing inlet is received in the upper end of the second housing.

12. The vacuum cleaner of claim 1, further comprising an outlet duct that directs the air stream out of the second cyclonic separator, wherein the inner and outer walls of the second housing inlet are between the outlet duct and the second housing.

13. The vacuum cleaner of claim 12, wherein the outlet duct, the second housing inlet, and the second housing are removable coupled together.

14. The vacuum cleaner of claim 1, wherein the outer wall tapers along the inlet flow direction.

* * * * *